US006807704B2

(12) United States Patent
Nishitani

(10) Patent No.: US 6,807,704 B2
(45) Date of Patent: Oct. 26, 2004

(54) BRUSH FLATTER AND DRAWING INSTRUMENT EQUIPPED WITH BRUSH FLATTER

(75) Inventor: Ichiro Nishitani, Yamatokoriyama (JP)

(73) Assignee: Kuretake Co., Ltd., Nara (JP)

( * ) Notice: Subject to any disclaimer, the term of this patent is extended or adjusted under 35 U.S.C. 154(b) by 0 days.

(21) Appl. No.: 10/334,345

(22) Filed: Dec. 30, 2002

(65) Prior Publication Data

US 2004/0068815 A1 Apr. 15, 2004

(30) Foreign Application Priority Data

Jan. 7, 2002 (JP) ..... 2002-000770

(51) Int. Cl.[7] ..... A46B 17/04
(52) U.S. Cl. ..... 15/168; 15/166; 15/DIG. 4
(58) Field of Search ..... 15/166, 168–170, 15/184, 246, DIG. 4

(56) References Cited

U.S. PATENT DOCUMENTS

| | | | | | |
|---|---|---|---|---|---|
| 1,090,829 | A | * | 3/1914 | Baldwin | 15/184 X |
| 2,155,004 | A | * | 4/1939 | Blossom | 15/168 X |
| 2,662,240 | A | * | 12/1953 | Perkins | 15/246 |
| 2,787,016 | A | | 4/1957 | Carpenter | 15/202 |
| 3,106,738 | A | * | 10/1963 | Bohne | 15/184 |
| 3,193,863 | A | * | 7/1965 | Myers et al. | 15/169 |
| 3,802,023 | A | * | 4/1974 | Spatz | 15/DIG. 4 |
| 4,129,918 | A | * | 12/1978 | Lee | 15/169 |
| 5,251,992 | A | * | 10/1993 | Lizuka | 15/168 X |

FOREIGN PATENT DOCUMENTS

| | | | | |
|---|---|---|---|---|
| DE | 1532994 | * | 7/1970 | 15/169 |
| GB | 7657 | * | 5/1890 | 15/169 |
| GB | 5123 | * | 3/1894 | 15/169 |
| GB | 610896 | * | 10/1948 | 15/168 |
| GB | 1097140 | | 12/1967 | |
| GB | 1440202 | | 6/1976 | |
| SE | 34243 | * | 9/1911 | 15/168 |

* cited by examiner

*Primary Examiner*—Mark Spisich
(74) *Attorney, Agent, or Firm*—Anthony J. Casella; Gerald E. Hespos

(57) ABSTRACT

A brush flatter is detachably attachable to a tip portion of a shaft of a drawing instrument having a brush member at the tip portion thereof. The brush flatter is provided with a casing having a space to allow the brush member of the drawing instrument to pass in an axial direction of the shaft, a shaft fitting portion formed at a proximal end portion of the casing, the shaft fitting portion having such a configuration as to fittingly seat on the tip portion of the shaft of the drawing instrument, and a brush pressing portion formed at a distal end portion of the casing, the brush pressing portion defining a slit-like opening through which a tip portion of the brush member pressedly passes so that an exposed tip portion of the brush member comes into a flat form when the shaft fitting portion of the casing fittingly seats on the tip portion of the shaft of the drawing instrument. A drawing instrument is attached with such brush flatter.

9 Claims, 3 Drawing Sheets

BRUSH FLATTER AND DRAWING INSTRUMENT EQUIPPED WITH BRUSH FLATTER

BACKGROUND OF THE INVENTION

1. Field of the Invention

This invention relates to a brush flatter for use in a drawing instrument such as writing brush and painting brush, which is detachably attachable to a tip portion of a shaft of the drawing instrument to shape a brush mounted on the shaft into a flattened shape, and a drawing instrument equipped with the brush flatter.

2. Description of the Related Art

There have been known writing brushes and painting brushes equipped with a brush comprising, e.g., a bundle of fibers which extends from a tip portion of a shaft thereof. Further, there have been proposed a variety of kinds of drawing instruments with different shapes of brushes to satisfy various demands of users. For instance, some drawing instruments are equipped with a brush having a large thickness. This type of brush has a generally circular shape viewed from a front side of the drawing instrument, and hereinafter is called as "thick brush". Others are quipped with a brush having a flat shape with a small thickness. This type of brush is hereinafter called as "thin or flat brush". Users use these different kinds of drawing instruments depending on the purpose of use such as what kind of lines, patterns, and color tones they attempt to draw or apply.

In the conventional drawing instruments, each drawing instrument is equipped with a brush of an individual shape. Accordingly, a user is required to use a plurality of kinds of drawing instruments according to needs. There rises a case that a user is required to prepare a multitude of kinds of drawing instruments depending on what the user intends to draw. This is uneconomical and involves cumbersome operation such as preparation of a multitude of kinds of drawing instruments beforehand, and putting them in order after use.

SUMMARY OF THE INVENTION

It is an object of the present invention to provide a brush flatter and a drawing instrument which are free from the problems residing in the prior art.

It is another object of the present invention to provide a brush flatter that enables a user to paint, draw or write pictures, patterns, and the like in various drawing or writing manners with use of a single writing or painting brush, and a drawing instrument equipped with such a brush flatter.

According to an aspect of the invention, a brush flatter is detachably attached to a tip portion of a shaft of a drawing instrument having a brush member at the tip portion thereof. The brush flatter includes a casing having a space to allow the brush member of the drawing instrument to pass in an axial direction of the shaft. The casing is provided with a shaft fitting portion formed at a proximal end portion thereof. The shaft fitting portion has such a configuration as to fittingly seat on the tip portion of the shaft of the drawing instrument. Also, the casing is provided with a brush pressing portion formed at a distal end portion thereof. The brush pressing portion defines a slit-like opening through which a tip portion of the brush member pressedly passes so that an exposed tip portion of the brush member comes into a flat form when the shaft fitting portion of the casing fittingly seats on the tip portion of the shaft of the drawing instrument.

In the above arrangement, the brush pressing portion of the brush flatter makes it possible to flatten the brush tip portion when being attached to the shaft. A drawing instrument provided with a thick brush having a circular cross section can be changed into a drawing instrument provided with a thin brush having a rectangular cross section according to needs.

These and other objects, features and advantages of the present invention will become more apparent upon a reading of the following detailed description and accompanying drawing.

DESCRIPTION OF THE PREFERRED EMBODIMENTS

Figure 5:
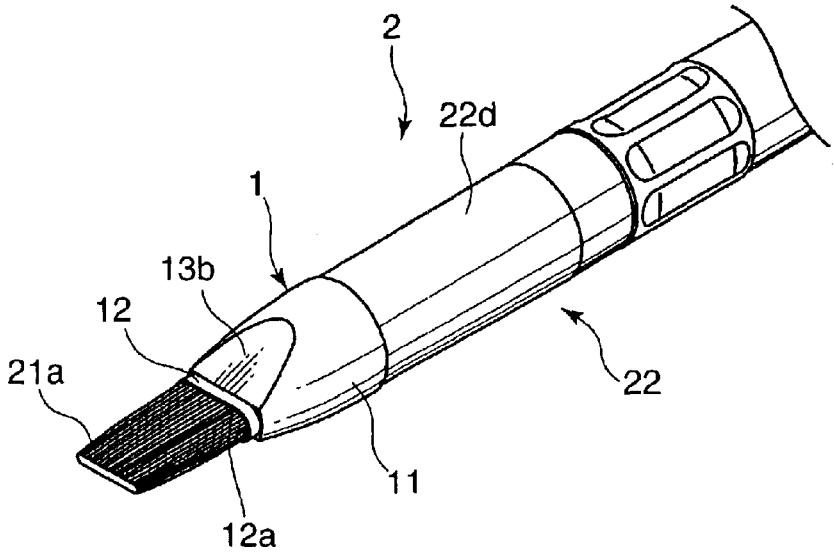
FIG. 5 is a perspective view showing the drawing instrument attached with the brush flatter.

A brush flatter and a drawing instrument equipped with a brush flatter in accordance with an embodiment of the invention are described with reference to the accompanying drawings. A brush flatter 1 is adapted to be detachably attached to a tip portion 22*a* of a shaft 22 of a drawing instrument 2 in such a manner that a brush 21 comprising a bundle of fibers, which is mounted at the shaft tip portion 22*a,* extends through the brush flatter 1 in an axial direction of the shaft 22. When the brush flatter 1 is detachably mounted on the shaft tip portion 22*a* of the drawing instrument 2, a tip portion 21*a* of the brush 21 is flattened, as shown in FIG. 5. The drawing instrument 2 comprises the brush flatter 1 and the shaft 22 including the brush 21.

The brush flatter 1 has such a configuration as to allow the brush 21 to pass therethrough in the axial direction of the shaft 22. A shaft fitting portion 11 is formed at a proximal end portion of the brush flatter 1 with respect to a direction of detachably mounting the brush flatter 1 on the shaft 22, and a brush pressing portion 12 is formed at a distal end portion of the brush flatter 1. The brush pressing portion 12 has a slit-like opening 12*a*. The brush flatter 1 further includes a guide portion 13 formed at an appropriate position between the shaft fitting portion 11 and the brush pressing portion 12. With this configuration, when the brush flatter 1 is detachably mounted on the shaft tip portion 22*a,* the brush tip portion 21*a* is allowed to be exposed out of the brush pressing portion 12 of the brush flatter 1 through the opening 12*a*.

In detachably mounting the brush flatter 1 on the shaft tip portion 22*a* of the drawing instrument 2, the brush 21 is brought into pressing contact with the shaft fitting portion 11. The inner diameter of the shaft fitting portion 11 is set substantially equal to the outer diameter of the brush tip portion 21*a*. Further, when the brush flatter 1 is detachably mounted on the shaft tip portion 22*a,* the shaft fitting portion 11 fittingly encases the outer circumference of the shaft tip portion 22*a* over its entirety. The shaft tip portion 22*a* has the outer diameter smaller than the outer diameter of a shaft main body 22*d* which is formed at a rear side of the shaft tip portion 22*a* in the attaching direction of the brush flatter 1. A stepped portion 22*b*, which is described later, is defined between the shaft tip portion 22*a* and the shaft main body 22*d*.

The brush flatter 1 is composed of an elastically deformable material such as polypropylene (PP) to render the shaft fitting portion 11 radially deformable. Radially inwardly protruding projections 111*a*, 111*b* are formed at respective appropriate positions on an inner wall region of the shaft fitting portion 11. With this construction, the shaft fitting portion 11 is elastically deformed depending on the size of diameter of the shaft 22 in detachably mounting the brush flatter 1 on the shaft tip portion 22*a* as the projections 111*a*, 111*b* are pressingly abutted against the outer circumference of the shaft tip portion 22*a*. Thereby, the shaft fitting portion 11 is securely attached to the shaft tip portion 22*a*, and the brush flatter 1 is stably mounted on the shaft tip portion 22*a*.

Figure 1:
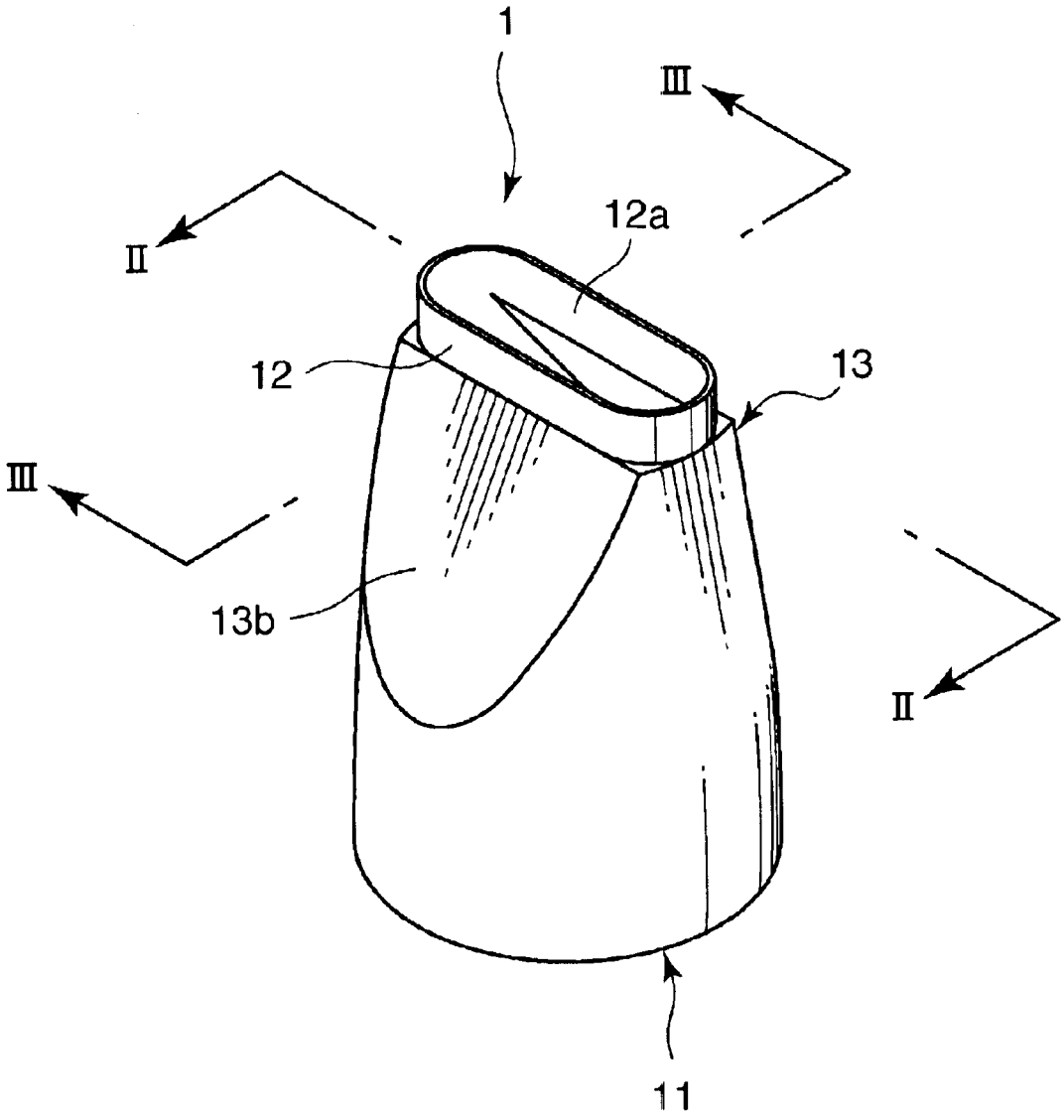
FIG. 1 is a perspective view showing a brush flatter in accordance with an embodiment of the invention.
Figure 2:
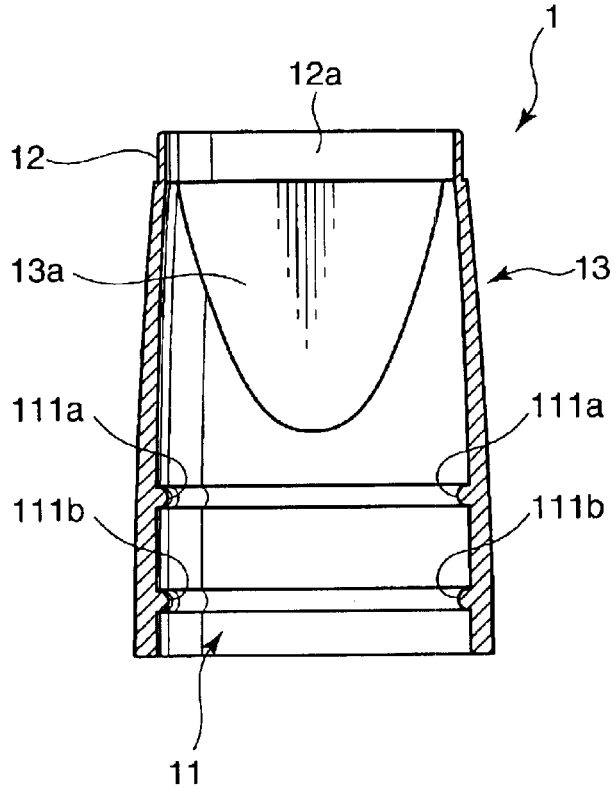
FIG. 2 is a sectional view of the brush flatter taken along the line II—II in FIG. 1.
Figure 3:
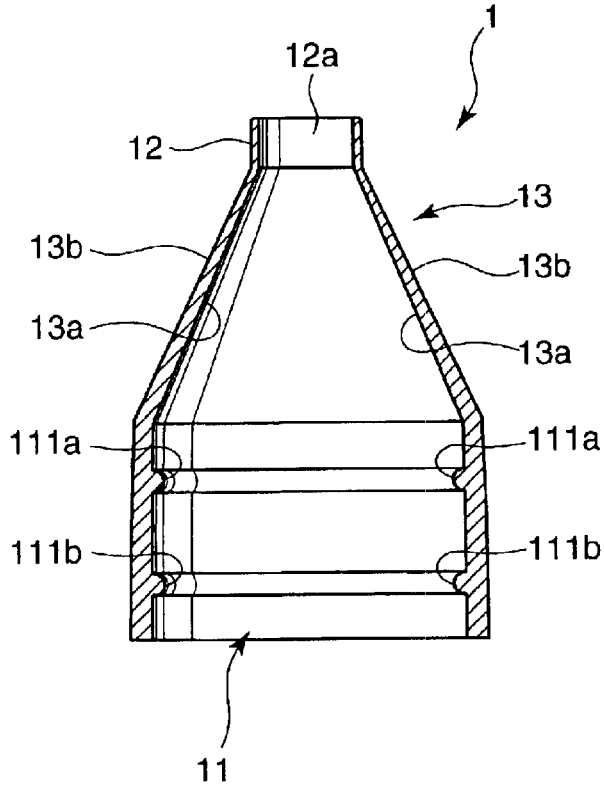
FIG. 3 is a sectional view of the brush flatter taken along the line III—III in FIG. 1.
Figure 4:
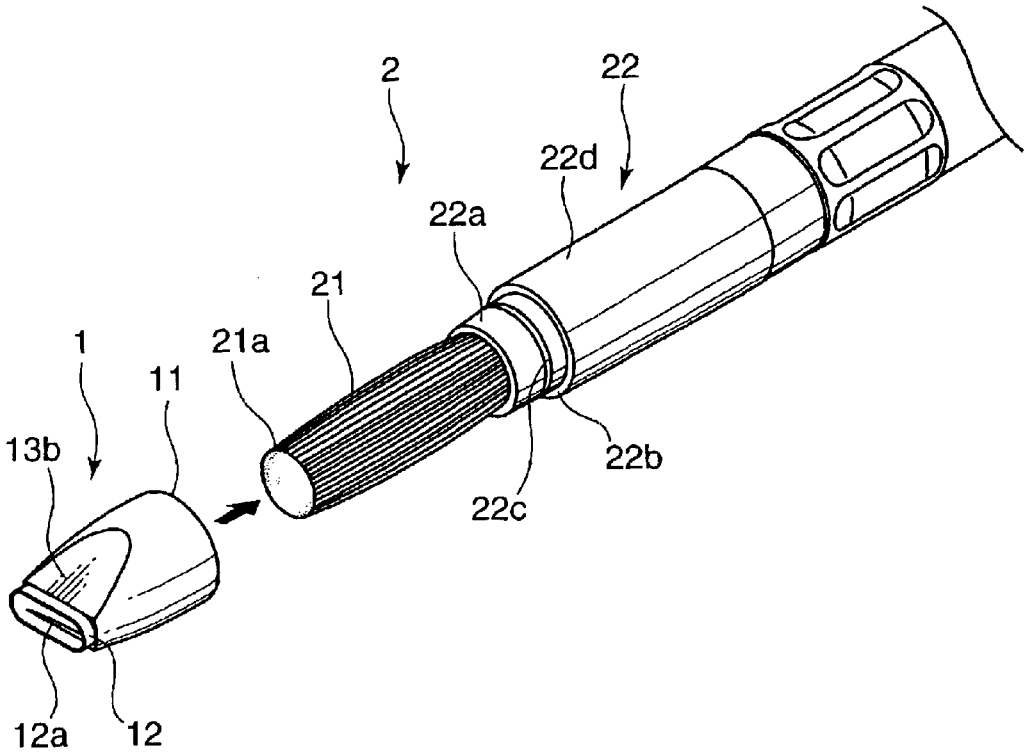
FIG. 4 is a perspective view showing a drawing instrument before the brush flatter is attached.

The opening 12*a* of the brush pressing portion 12 has a length substantially equal to the outer diameter (i.e., thickness) of the brush 21, for example, as shown in FIG. 4. The opening 12*a* may take a variety of shapes such as a rectangular shape, an oblong or oval shape having a minor diameter greatly smaller than a major diameter, and an elliptical shape in plan view. When the brush flatter 1 is detachably mounted on the shaft tip portion 22*a* of the drawing instrument 2, the brush tip portion 21*a* is exposed outside from the brush pressing portion 12 through the slit-like opening 12*a*. The brush pressing portion 12 serves to flatten the brush tip portion 21*a* as the brush 21 is pressingly inserted through the opening 12*a* with a pressing force being applied to the brush 21 so as to change the brush tip portion 21*a* into a configuration generally identical to the opening 12*a*. The dimensions of the opening 12*a* may be such that the fibers of the brush 21 are uniformly accommodated in the brush pressing portion 12 substantially without clearance or with less clearance and are securely held therein.

The brush pressing portion 12 extends in a direction generally parallel with the axial direction of the shaft 22 while securing the contour of the opening 12*a*. With this construction, when the brush 21 is passed through the brush flatter 1, the brush pressing portion 12 serves to align the fiber direction of the brush 21 generally in parallel with the axial direction of the shaft 22 while tightly encasing the brush 21 therein, as well as flattening the brush tip portion 21*a* of the brush 21. In view of this, the brush pressing portion 12 is also functioned as a brush retaining portion. The brush tip portion 21*a* which is exposed out of the brush pressing portion 12 becomes rigid to make it possible for a user to perform stable writing or drawing even if a relatively large external force is applied to the drawing instrument 2 at the time of writing or drawing. Further, the rigidity degree of the brush tip portion 21*a* which is exposed out of the brush pressing portion 12 can be regulated by optimally setting the length of the brush pressing portion 12 in the axial direction of the shaft 22 as long as the perimeter contour of the opening 12*a* of the brush pressing portion 12 is retained.

The guide portion 13 is defined in a region of the brush flatter 1 between the shaft fitting portion 11 and the brush pressing portion 12. The guide portion 13 includes a pair of planar tapered portions 13*a*, 13*a* each of which is formed in an inner surface of the guide portion 13. The planar tapered portions 13*a*, 13*a* oppose to each other with a certain distance. The planar tapered portions 13*a*, 13*a* have such a configuration that the distance therebetween decreases toward the distal end portion of the brush flatter 1. The planar tapered portions 13*a*, 13*a* serve to guide the brush tip portion 21*a* to the brush pressing portion 12 as the brush tip portion 21*a* is passed through the brush flatter 1 from the shaft fitting portion 11. Specifically, the guide portion 13 serves to aid change of the brush 21 from its initial shape (in the embodiment, circular shape in plan view as shown in FIG. 4) into a flattened shape as shown in FIG. 5, as the brush tip portion 21*a* is passed through the brush flatter 1.

The guide portion 13 further includes a pair of planar tapered portions 13*b*, 13*b* each of which is formed in an outer surface of the guide portion 13 corresponding to the inner tapered portions 13*a*, 13*a*, respectively. Specifically, the guide portion 13 has a tapered configuration as its outer shape in such a manner that each of the inner tapered portions 13*a*, 13*a* and the outer tapered portions 13*b*, 13*b* is so inclined as to decrease the distance between the tapered portions 13*a* and 13*a* (13*b* and 13*b*) toward the distal end portion of the brush pressing portion 12. With this configuration, a user is enabled to grip the drawing instrument 2 easily, thereby improving operability in writing and drawing.

When the brush flatter 1 is detachably attached to the drawing instrument 2, as shown in FIG. 4, a user slides the brush flatter 1 onto the brush 21 in a state that the brush tip portion 21*a* is passed through the shaft fitting portion 11. Then, the user gradually slides the brush flatter 1 toward the shaft tip portion 22*a* along the axial direction of the shaft 22. In this way, the brush 21 is passed through the brush flatter 1 until the shaft fitting portion 11 of the brush flatter 1 fittingly encases the outer circumference of the shaft tip portion 22*a*. As the shaft fitting portion 11 encases the shaft tip portion 22*a*, the shaft fitting portion 11 is elastically deformed depending on the size of the diameter of the shaft tip portion 22*a*. In this way, the shaft fitting portion 11 is fittingly mounted on the shaft tip portion 22*a* in a state that the projections 111*a*, 111*b* of the shaft fitting portion 11 are pressingly abutted against the shaft tip portion 22*a* with elastic deformation of the shaft fitting portion 11. Finally, the brush flatter 1 is set to a state as shown in FIG. 5 where the peripheral portion of the shaft fitting portion 11 is abutted against the stepped portion 22*b* which is defined at a boundary portion between the shaft tip portion 22*a* and the shaft 22. Thus, the drawing instrument 2 is brought to another usable state where the brush flatter 1 is detachably attached to the shaft tip portion 22*a*.

The stepped portion 22*b* is defined by a radial difference between the outer diameter of the shaft tip portion 22*a* and the outer diameter of the shaft main body 22*d* which is formed on the rear side of the shaft tip portion 22*a*. The radial dimension of the stepped portion 22*b* is set substantially equal to the thickness of the wall portion of the brush flatter 1. Since the radial dimension of the stepped portion 22*b* is generally equal to the thickness of the wall portion of the brush flatter 1, the outer circumferential configuration of the shaft main body 22*d* is rendered generally coincident with the outer circumferential configuration of the shaft fitting portion 11 to render the outer surface of the shaft main body 22*d* substantially flush with the outer surface of the shaft fitting portion 11 in an attached state. It is very likely that a user grips the boundary portion between the brush flatter 1 and the shaft main body 22*d* in using the drawing instrument 2. Eliminating or suppressing a radial difference between the shaft 22 and the brush flatter 1 in an attached state enables to ensure comfortable writing or drawing without impairing operability of the drawing instrument 2 in a state that the brush flatter 1 is detachably attached to the shaft tip portion 22*a*.

The shaft 22 further includes an engaging portion 22*c* formed at a proximal end portion of the shaft tip portion 22*a* in the direction of attaching the brush flatter 1. The engaging portion 22*c* has the outer diameter slightly larger than the outer diameter of the shaft tip portion 22*a*. The engaging portion 22*c* is formed at such a position as to engage the projection 111*b* of the shaft fitting portion 11 when the brush flatter 1 is pressingly abutted against the stepped portion 22*b*. When detachably mounting the brush flatter 1 onto the shaft tip portion 22*a*, the shaft fitting portion 11 fittingly encases the shaft tip portion 22*a*. As the shaft fitting portion 11 fittingly encases the shaft tip portion 22*a*, the projection 111*b* of the shaft fitting portion 11 is pressingly abutted against the engaging portion 22*c*, whereby the shaft fitting portion 11 is elastically deformed to elastically move the projection 111*b* toward the stepped portion 22*b* over the engaging portion 22*c*. Thus, the projection 111*b* is pressingly abutted against the engaging portion 22*c* and seated thereon. Engagement of the projection 111*b* with the engaging portion 22*c* restricts the brush flatter 1 from axially displacing rearward of the shaft 22. With this arrangement, after the brush flatter 1 is detachably mounted on the shaft tip portion 22*a*, the shaft fitting portion 11 is kept from being displaced axially relative to the shaft tip portion 22*a*. This arrangement ensures detachably attaching the brush flatter 1 onto the drawing instrument 2 and stabilizes the mounted state of the brush flatter 1 on the shaft tip portion 22*a*.

The shaft 22 may be of a pen type having a structure in which an ink reservoir is provided to store ink therein to feed the ink to the brush 21 mounted at the shaft tip portion 22*a*, or of a painting or writing brush type which is used, for example by applying paint or ink onto the brush 21. In particular, since a drawing instrument equipped with a shaft in which an ink chamber is provided is expensive, the aforementioned arrangement is remarkably advantageous in reducing production cost of the drawing instrument because detachably attaching the brush flatter 1 onto the shaft 22 enables to desirably change the configuration of the tip portion 21*a* of the brush 21.

Further, it is possible to change the brush tip portion 21*a* into various shapes by preparing a plurality of different kinds of brush flatters having openings of different contours in plan view at a distal end portion thereof. With such an altered arrangement, usability of the drawing instrument is further improved.

As described above, an inventive brush flatter is detachably attachable to a tip portion of a shaft of a drawing instrument having a brush member at the tip portion thereof. The brush flatter comprises a casing having a space to allow the brush member of the drawing instrument to pass in an axial direction of the shaft; a shaft fitting portion formed at a proximal end portion of the casing, the shaft fitting portion having such a configuration as to fittingly seat on the tip portion of the shaft of the drawing instrument; and a brush pressing portion formed at a distal end portion of the casing, the brush pressing portion defining a slit-like opening through which a tip portion of the brush member pressedly passes so that an exposed tip portion of the brush member comes into a flat form when the shaft fitting portion of the casing fittingly seats on the tip portion of the shaft of the drawing instrument.

With the above-constructed brush flatter, the brush tip portion can be flattened by pressing force of the brush pressing portion against the brush by merely fittingly encasing the shaft fitting portion on the shaft tip portion in passing the brush of the drawing instrument through the brush flatter. Accordingly, a drawing instrument equipped with a thick brush having a large diameter, e.g., a circular cross section, can be used as a drawing instrument equipped with a thin brush having a small thickness, e.g., a rectangular cross section. Thus, the inventive brush flatter provides a drawing instrument with multiple use. This arrangement enables to decrease the number of drawing instruments at a time of drawing, writing or its equivalent operation, thus contributing to economical efficiency and improving operability of the drawing instrument.

The casing may be preferably provided with a guide portion defined between the brush fitting portion and the brush pressing portion, the guide portion having an inner surface for guiding the tip portion of the brush member from the shaft fitting portion to the brush pressing portion.

In the above-constructed brush flatter, the brush tip portion that has been inserted through the brush flatter from the shaft fitting portion is guided to the brush pressing portion along the inner surface of the guide portion. This arrangement enables to smoothly insert the brush tip portion to the brush pressing portion even if the perimeter contour of the opening of the brush pressing portion differs greatly from the perimeter contour of the shaft fitting portion, thus smoothly changing the shape of the brush tip portion into a shape substantially coincident with the contour of the opening of the brush pressing portion. Further, the inner surface of the brush flatter has such a configuration as to suppress obstructive insertion of the brush tip portion through the brush flatter. Accordingly, this arrangement is effective in alleviating damage of the brush tip portion in detachably attaching the brush flatter on the shaft of the drawing instrument.

The inner surface of the guide portion may be preferably formed with a pair of ramp portions opposing to each other with respect to the opening, the ramp portions inclining in such a direction that the distance between the opposite ramp portions decreases toward the distal end portion of the casing.

With the above arrangement, the brush tip portion can be smoothly changed into a flattened shape with a simplified construction.

The brush pressing portion may be extended in the axial direction of the shaft to pressingly retain the shape of an exposed part of the tip portion of the brush member substantially coincident with a perimeter contour of the opening while securing the perimeter contour of the opening.

In the above arrangement, the brush pressing portion not only serves to flatten the brush tip portion by exerting pressing force onto the brush but also serves to retain the shape of the exposed part of the brush tip portion along an axially extending portion of the brush pressing portion while securing the perimeter contour of the opening of the brush pressing portion. Thereby, the exposed part of the brush tip portion from the brush pressing portion becomes rigid, and a user is enabled to carry out stable writing or drawing even if a relatively large external force is applied to the drawing instrument in writing or drawing. Further, the rigidity degree of the brush tip portion which is exposed out of the brush pressing portion can be regulated by optimally setting the length of the brush pressing portion in the axial direction of the shaft while securing the perimeter contour of the opening of the brush pressing portion.

An inventive drawing instrument includes a shaft provided with a brush member extending in an axial direction of the shaft from a tip portion of the shaft, and the above-mentioned inventive brush flatter.

The tip portion of the shaft may preferably have an outer diameter to allow the shaft fitting portion of the brush flatter to fittingly encase the shaft tip portion, In the above-constructed drawing instrument, preferably, the shaft tip portion may have an outer diameter smaller than that of the shaft main body, and the stepped portion may be defined between the shaft tip portion and the shaft main body in such a manner that the outer circumferential configuration of the shaft fitting portion and the outer circumferential configuration of the shaft main body are set substantially coincident with each other when the shaft fitting portion is detachably mounted on the shaft tip portion.

In the above arrangement, since the shaft fitting portion mounted on the shaft tip portion and the shaft main body are rendered substantially flush with each other with almost no step portion, a user is enabled to grip the boundary portion between the shaft fitting portion of the brush flatter and the shaft main body without incongruity. This arrangement provides a user with easy gripping, and enables the user to carry out writing or drawing comfortably in a similar manner as the brush flatter is not attached to the drawing instrument.

It should be appreciated that the arrangement of fittingly encasing the shaft fitting portion on the shaft tip portion can take various forms. For instance, as described in the embodiment, the shaft fitting portion may be radially elastically deformable, and the projection formed at the inner wall region of the shaft fitting portion may be pressingly abutted against the outer circumference of the shaft tip portion. With this arrangement, when the shaft fitting portion is detachably mounted on the shaft tip portion, the shaft fitting portion is elastically deformed depending on the size of the diameter of the shaft tip portion, and the projection is brought to a pressing contact state with the shaft tip portion with a pressing force exerted to the projection. This arrangement ensures fittingly mounting the brush flatter onto the shaft tip portion and stabilizes the mounted state of the brush flatter on the shaft tip portion.

Further, preferably, an engaging portion may be formed at an appropriate position on the shaft tip portion in such a manner that the engaging portion engages the projection formed at the inner wall region of the shaft fitting portion of the brush flatter to restrict the brush flatter from axially displacing rearward toward the shaft main body. With such an arrangement, engagement of the projection with the engaging portion enables to restrict the shaft fitting portion from axially displacing relative to the shaft tip portion. This arrangement ensures stable mounting of the brush flatter on the shaft tip portion without likelihood that the brush flatter is disengaged from the shaft of the drawing instrument.

This application is based on Japanese patent application No. 2002-000770 filed on Jan. 7, 2002, the contents of which are hereby incorporated by references.

As this invention may be embodied in several forms without departing from the spirit of essential characteristics thereof, the present embodiment is therefore illustrative an not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. A drawing instrument comprising:

a shaft having a tip portion defining a tip portion radius, the shaft further having a main body defining a main body radius and a main body diameter;

a brush member mounted on the tip portion of the shaft and having fibers extending in an axial direction of the shaft from the tip portion of the shaft; and a brush flatter including:

a casing having a space to allow the brush member of the drawing instrument to pass in the axial direction of the shaft;

a shaft fitting portion formed at a proximal end portion of the casing, the shaft fitting portion having a thickness substantially equal to a difference between the tip portion radius and the main body radius, and the shaft fitting portion having an outer diameter that is substantially equal to the main body diameter of the shaft to render an outer circumference of the shaft fitting portion of the flatter substantially flush with an outer circumference of the main body of the shaft when the shaft fitting portion of the brush flatter is detachably seated on the tip portion of the shaft of the drawing instrument; and a brush pressing portion formed at a distal end portion of the casing, the brush pressing portion defining a slit-like opening through which a tip portion of the brush member pressedly passes so that an exposed tip portion of the brush member shapes into a flat form when the shaft fitting portion of the casing fittingly seats on the tip portion of the shaft of the drawing instrument, the brush pressing portion having a side wall extending in parallel with the axial direction of the shaft to align the fibers of the brush member.

2. The drawing instrument according to claim 1, wherein the casing includes a guide portion defined between the shaft fitting portion and the brush pressing portion, the guide portion having an inner surface for guiding the tip portion of the brush member from the shaft fitting portion to the brush pressing portion.

3. The drawing instrument according to claim 2, wherein the guide portion includes a pair of ramp portions opposing to each other with respect to the opening, the ramp portions inclining in such a direction that the distance between the opposite ramp portions decreases toward the distal end portion of the casing, and each of the ramp portions having planar inner and outer surfaces.

4. A drawing instrument comprising:

a shaft having a tip portion;

a brush member mounted on the tip portion of the shaft and having fibers extending in an axial direction of the shaft from the tip portion of the shaft; and a brush flatter made of an elastic material and including:

a casing having a space to allow the brush member of the drawing instrument to pass in the axial direction of the shaft;

a shaft fitting portion formed at a proximal end portion of the casing, the shaft fitting portion having such a configuration as to fittingly seat on the tip portion of the shaft of the drawing instrument, and the shaft fitting portion of the brush flatter includes an inner surface having a projection configured for engaging an outer circumferential surface of the tip portion of the shaft when the shaft fitting portion fits on the tip portion of the shaft; and a brush pressing portion formed at a distal end portion of the casing, the brush pressing portion defining a slit-like opening through which a tip portion of the brush member pressedly passes so that an exposed tip portion of the brush member shapes into a flat form when the shaft fitting portion of the casing fittingly seats on the tip portion of the shaft of the drawing instrument, the brush pressing portion having a side wall extending in parallel with the axial direction of the shaft to align the fibers of the brush member.

5. The drawing instrument according to claim 4, wherein an engaging portion is formed on the outer circumferential surface of the tip portion of the shaft to be engaged by the projection of the brush flatter when the shaft fitting portion fits on the tip portion of the shaft.

6. A drawing instrument comprising:

a shaft having a main body with a diameter and a radius and a tip portion having a radius smaller than the radius of the main body;

a brush member mounted on the tip portion of the shaft and extending in an axial direction of the shaft from the tip portion of the shaft; and a brush flatter to be detachably coupled with the shaft, the brush flatter including:

a casing having a space to allow the brush member of the drawing instrument to pass in an axial direction of the shaft;

a shaft fitting portion formed at a proximal end portion of the casing, the shaft fitting portion having a diameter that is substantially equal to the diameter of the main body of the shaft and the shaft fitting portion having a thickness that is substantially equal to a difference of the radiuses of the main body and the tip portion of the shaft; and a brush pressing portion formed at a distal end portion of the casing, the brush pressing portion defining a slit-like opening through which a tip portion of the brush member pressedly passes so that an exposed tip portion of the brush member shapes into a flat form when the shaft fitting portion of the casing fittingly seats on the tip portion of the shaft of the drawing instrument.

7. The drawing instrument according to claim 6, wherein the brush flatter is made of an elastic material, and the shaft fitting portion of the brush flatter includes a projection on an inner wall of the brush flatter to engage an outer circumference of the tip portion of the shaft when the shaft fitting portion fits on the tip portion of the shaft.

8. The drawing instrument according to claim 7, wherein an engaging portion is formed on the outer circumference of the tip portion of the shaft to be engaged by the projection of the brush flatter when the shaft fitting portion fits on the tip portion of the shaft.

9. The drawing instrument according to claim 6, wherein the brush pressing portion includes a side wall aligned parallel to the axial direction of the shaft.

* * * * *